US006430900B1

(12) United States Patent
Luttmann et al.

(10) Patent No.: US 6,430,900 B1
(45) Date of Patent: Aug. 13, 2002

(54) METHOD FOR THE MANUFACTURING OF A SEALED CONTAINER

(76) Inventors: Jurgen Luttmann, Wickenweg 6, 27208 Kirchlinteln; Hans-Richard Kiel, Eibinger Strasse 66, 28876 Oyten; Gebhard Kregel, Nr. 55, 27374 Visselhovede; Marco Schreiber, Alma-Rogge-Weg 46, 27283 Verden, all of (DE)

( * ) Notice: Subject to any disclaimer, the term of this patent is extended or adjusted under 35 U.S.C. 154(b) by 0 days.

(21) Appl. No.: 09/463,196

(22) PCT Filed: Jul. 23, 1998

(86) PCT No.: PCT/DE98/02211

§ 371 (c)(1),
(2), (4) Date: Jul. 18, 2000

(87) PCT Pub. No.: WO99/05040

PCT Pub. Date: Feb. 4, 1999

(30) Foreign Application Priority Data

Jul. 23, 1997 (DE) ..... 197 31 654

(51) Int. Cl.[7] ..... B65B 51/10; B65B 7/02; B65B 7/14

(52) U.S. Cl. ..... 53/479; 53/476; 53/477

(58) Field of Search ..... 53/479, 485, 488, 53/477, 478

(56) References Cited

FOREIGN PATENT DOCUMENTS

| | | | | |
|---|---|---|---|---|
| DE | 659 633 A5 | * | 2/1987 | ..... B65D/41/50 |
| GB | 1087437 | * | 2/1965 | ..... B65D/51/20 |

* cited by examiner

*Primary Examiner*—John Sipos
*Assistant Examiner*—Hemant M. Desai
(74) *Attorney, Agent, or Firm*—Dorsey & Whitney LLP

(57) ABSTRACT

A method for the manufacture of a container sealed in sterile manner by a foil and which comprises a container body and at least one closure placed over the foil, wherein prior to the closure of the container with the closure, a foil is laminated on the side of the closure facing the container interior after closing. The closure container closed with the closure undergoes a heat treatment at a temperature adequate to bond the foil to the wall of the container body in the vicinity of the closure and so extensively detach it from the closure that during a subsequent removal of the closure the foil remains adhering to the container body and a container manufacturable by said method.

4 Claims, 1 Drawing Sheet

METHOD FOR THE MANUFACTURING OF A SEALED CONTAINER

FIELD OF THE INVENTION

The application relates to a method for the manufacture of a container, sealed in sterile manner by a foil or film and comprising a container body and at least one closure placed over the foil or film, as well as to a container manufactured by this method.

BACKGROUND OF THE INVENTION

In the food and feed industry in many cases there is a need to seal, in a microbiologically sterile manner, a container in which the food or feed is packed. A microbially sterile seal can be achieved with the most varied methods, which range from the preserving jar, via various can closures to tray containers with pull-off foil lids. Particularly in those cases where it is simultaneously sought to provide a manually easily openable lid closure, it must be ensured by additional measures that, in the case of an unintentional opening of the can or container during storage, transportation, etc. the necessary microbiological sterility of the container content is ensured up to the time of intended opening by the consumer. It has been proposed for such cases that the container interior is initially sealed in microbiological sterile manner by a bonded or welded on foil and over said foil closure, particularly for greater stability and durability of the closure during storage, transportation, etc., is provided a stronger lid closure.

However, this type of container closure suffers from the disadvantage that it is necessary to fit in two separate steps two different closures, namely the foil closure for microbiological sterile sealing and the lid closure placed above the latter for increasing stability and durability, which gives rise to higher time and equipment costs and therefore higher overall costs.

Therefore the problem overcome by the present invention is to obviate the disadvantages of the prior art and make available a method with which, particularly in the last-discussed cases, a microbiologically sterile and storage and transportation-stable closure of a container can be inexpensively and easily manufactured.

SUMMARY OF THE INVENTION

In the case of the aforementioned method, the invention solves this problem in that prior to the closure of the container with the closure, on the side facing the container interior after closing, a foil is laminated and that the entire container closed with the closure undergoes a heat treatment at a sterilization and pasteurization temperature for the container content adequate to bond the foil to the wall of the container body in the vicinity of the closure. Thus, during a subsequent removal of the closure, because of a higher adhesion between foil and container body than between foil and closure, the foil remains adhering to the container body.

According to a preferred embodiment of the invention, the heat treatment takes place at a temperature of at least 50° C.

According to a preferred embodiment of the invention, a coextruded material is used for the foil and is preferably a coextruded material based on polyethylene and polypropylene.

The invention also relates to a container manufactured according to the inventive method.

By means of the method according to the invention, it is possible to obviate the hitherto necessary method step of microbially sterile sealing of the container after filling by bonding or welding on a foil. The method according to the invention uses the temperatures necessary for the heat treatment, such as the sterilization or pasteurization of the container content, in order to bond a foil laminated on the closure to the container wall and consequently achieve the desired, two-part sealing of the container, which comprises the microbiologically sterile sealing by the foil and the lid closure giving the necessary stability for storage, transportation, etc.

DESCRIPTION OF THE DRAWINGS

The method of the present invention is illustrated by the accompanying drawing wherein.

In detail, the method according to the invention is performed in the following way.

After filling the container body, e.g. a can, with the corresponding container content, in a corresponding plant, which requires no reequipping for this purpose, the lid is supplied, which has a foil laminated onto its side which faces the container interior after closure. The laminating of the foil or film can take place in the conventional manner, e.g. using wax, adhesive, etc.

The filled can is then closed using the correspondingly prepared lid in the conventional manner. The closed can is then supplied to a corresponding heat treatment for sterilization or pasteurization of the container content. During the sterilization or pasteurization process, the side of the foil facing the container content is bonded to the container body wall in the lid area and consequently ensures a reliable, microbiologically sterile closure of the container. Simultaneously, through the action of heat, there is such an extensive detachment of the foil from the closure, such as e.g. a sheet metal lid, that when the closure is opened the foil remains adhering to the container body instead of to the closure, i.e. the adhesion between the foil and container body is much greater than between the foil and the closure. Thus, in the case of an unintentional opening of the closure, such as can occur with easily opening closure systems, such as turning lids, lever lids, etc., a microbiologically sterile sealing of the container content is still ensured. Prior to the use of the packed product, by simply pulling off the foil bonded to the container body, the consumer can expose the container content.

Fundamentally numerous foil or film materials are suitable for use in the method according to the invention, provided that it is ensured that during the heat treatment the detachment of the foil from the closure and the bonding of the foil to the container body wall take place. Particular preference is given to coextruded foils, which on their different sides have different behaviour characteristics, i.e. for example at the sterilization or pasteurization temperature are detached from the closure by an irreversible destruction of the lamination or lining, without a bonding of the corresponding foil side taking place to the closure and being firmly bonded on the other foil side to the container body wall. As a function of the necessary heat treatment temperatures, which can be at least 50° C. for pasteurization, the expert can make a suitable choice of foil materials satisfying the corresponding requirements. In the case of sterilization temperatures round 120° C., e.g. coextruded material based on polyethylene and polypropylene has proved to be ideally suited.

Figure 2:
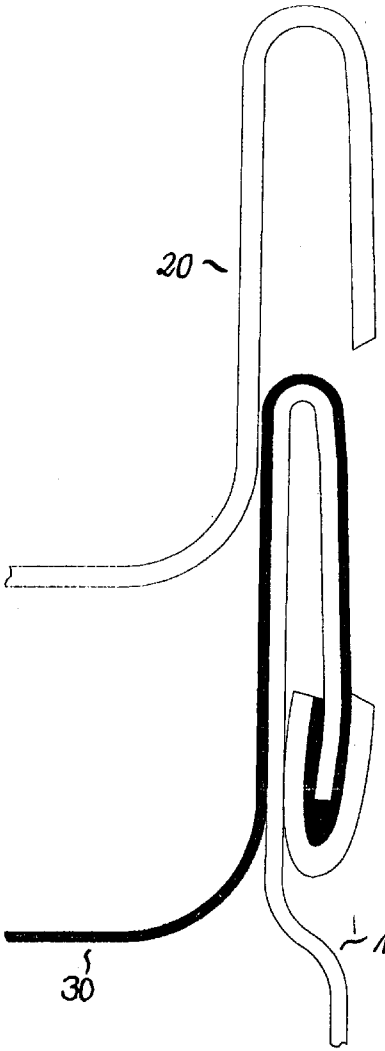
FIG. 2 is a view similar to FIG. 1 after the opening of the container.
Figure 1:
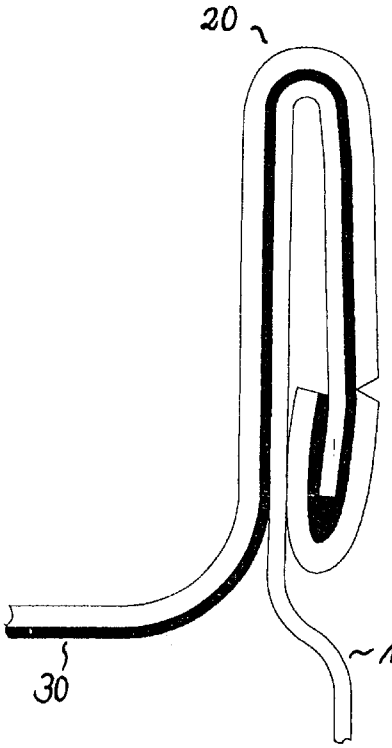
FIG. 1 is a partial view of a container sealed prior to the opening.

FIGS. 1 and 2 show the container body 10 and closure 20. On the side of the closure 20 facing the container interior is shown a film or foil 30, which is laminated according to the invention onto the closure 20, before the container is closed by the closure.

In the method according to the invention, during the sterilization of the closed container, there is a detachment of the foil 30 from the closure 20 and a bonding in the contact area of the foil 30 with the container body 10.

On opening the container by lifting off or unscrewing the closure 20 from the container body 10, as is e.g. shown in FIG. 2, the foil 30 remains connected to the container body and consequently initially continues to ensure a sterilization-proof sealing of the container.

The features of the invention disclosed in the above description, claims and drawings can be essential to the different embodiments of the invention, either singly or in random combination.

What is claimed is:

1. A method for manufacturing a sealed sterile container which comprises a container body and at least one closure member comprising the steps of:

(1) laminating a foil to the side of said closure member which faces said container body after said closure member is secured to said container body;

(2) securing said closure member to said container body;

(3) heat treating the entire container body with said closure member secured therein; and wherein (4) said heat treating is carried out at a temperature adequate to bond said foil to said container body and to release the bond between said foil and said closure member so that upon subsequent removal of said closure member said foil remains fixed to said container body.

2. A method according to claim 1 wherein said heat treatment takes place at a temperature of at least 50° C.

3. A method according to claim 1 wherein said foil is a coextruded material.

4. A method according to claim 3 wherein said coextruded material is a material based on polyethylene and polypropylene.

* * * * *